US010039313B2

(12) United States Patent
Mironov

(10) Patent No.: US 10,039,313 B2
(45) Date of Patent: Aug. 7, 2018

(54) TWO PART MULTI-COMPONENT COMBINER

(71) Applicant: Philip Morris Products S.A., Neuchatel (CH)

(72) Inventor: Oleg Mironov, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 728 days.

(21) Appl. No.: 14/398,070

(22) PCT Filed: Mar. 15, 2013

(86) PCT No.: PCT/EP2013/055465
§ 371 (c)(1),
(2) Date: Oct. 30, 2014

(87) PCT Pub. No.: WO2013/164124
PCT Pub. Date: Nov. 7, 2013

(65) Prior Publication Data

US 2015/0122273 A1 May 7, 2015

(30) Foreign Application Priority Data

Apr. 30, 2012 (EP) ..... 12166186

(51) Int. Cl.
*A24C 5/00* (2006.01)
*A24D 3/02* (2006.01)
*A24F 47/00* (2006.01)

(52) U.S. Cl.
CPC ..... *A24C 5/00* (2013.01); *A24D 3/0287* (2013.01); *A24F 47/004* (2013.01); *A24F 47/006* (2013.01)

(58) Field of Classification Search
CPC ..... A24C 5/475; A24D 3/0287; A24F 47/006
See application file for complete search history.

(56) References Cited

U.S. PATENT DOCUMENTS 2,821,200 A * 1/1958 Korber ..... A24C 5/475 131/94
5,392,792 A 2/1995 Banerjee et al.
(Continued)

FOREIGN PATENT DOCUMENTS

CN 1086407 A 5/1994
CN 1190873 A 8/1998
(Continued)

OTHER PUBLICATIONS

Combined Office Action and Search Report dated May 23, 2017 in Taiwanese Patent Application No. 102114747 (with English language translation).
(Continued)

*Primary Examiner* — Eric Yaary
(74) *Attorney, Agent, or Firm* — Oblon, McClelland, Maier & Neustadt, L.L.P.

(57) ABSTRACT

The present invention provides a method and apparatus for manufacturing smoking articles. First multi-segment components are formed each comprising a combustible heat source, an aerosol-forming substrate and an airflow directing segment by feeding a stream of combustible heat sources, aerosol-forming substrates and airflow directing segments along a moving delivery path, compacting the segments into groups; wrapping each group; and cutting the web of material between groups to separate the individual first multi-segment components from each other. A stream of first multi-segment components are fed onto a receiving means, and a stream of second multi-segment components, each comprising a mouthpiece and at least one further segment, are also fed onto the receiving means. A first multi-segment component and a second multi-segment component are combined by wrapping the components in a web material to
(Continued)

form an individual smoking article having a combustible heat source at a first end and a mouthpiece at a second end.

8 Claims, 5 Drawing Sheets

(56) References Cited

U.S. PATENT DOCUMENTS

| | | | | |
|---|---|---|---|---|
| 5,469,871 | A | 11/1995 | Barnes et al. | |
| 5,819,751 | A | 10/1998 | Barnes et al. | |
| 2007/0117700 | A1 | 5/2007 | Kushihashi et al. | |
| 2009/0065011 | A1* | 3/2009 | Maeder | A24F 47/006 131/194 |
| 2009/0145449 | A1 | 6/2009 | Cieslikowski et al. | |
| 2012/0067360 | A1 | 3/2012 | Conner et al. | |
| 2012/0157278 | A1 | 6/2012 | Cieslikowski et al. | |

FOREIGN PATENT DOCUMENTS

| | | | |
|---|---|---|---|
| CN | 101094599 | A | 12/2007 |
| CN | 101896083 | A | 11/2010 |
| CN | 102271543 | A | 12/2011 |
| EP | 1 767 107 | | 3/2007 |
| EP | 2 210 509 | | 7/2010 |
| JP | H06-189733 | A | 7/1994 |
| JP | 11-507234 | | 6/1999 |
| JP | 2008-525009 | | 7/2008 |
| JP | 2011-505818 | T | 3/2011 |
| TW | 200946241 | A1 | 11/2009 |
| WO | WO 2006/004111 | | 1/2006 |
| WO | WO 2010/076653 | A1 | 7/2010 |
| WO | WO 2011/139730 | | 11/2011 |

OTHER PUBLICATIONS

Office Action dated Feb. 15, 2017 in Japanese Patent Application No. 2015-509340 (with English translation).

Extended European Search Report dated Nov. 6, 2012 in Patent Application No. 12166186.2.

International Search Report dated Jun. 28, 2013 in PCT/EP13/055465 Filed Mar. 15, 2013.

Japanese Office Action dated Feb. 7, 2018 in corresponding Japanese Patent Application No. 2015-509340 with English translation.

Combined Office Action and Search Report dated Aug. 2, 2017 in Chinese Patent Application No. 201380031700.0 (with English translation).

* cited by examiner

TWO PART MULTI-COMPONENT COMBINER

CROSS REFERENCE TO RELATED APPLICATION

This application is a national phase application based on PCT/EP2013/055465, filed Mar. 15, 2013.

The present invention relates to a method and apparatus for manufacturing smoking articles in a multi-stage process. In particular, the invention relates to a method and apparatus for combining multi-segment components.

Apparatus and processes for manufacturing smoking articles consisting of a plurality of components are known in the art. For example, a rolling process may be used in which the smoking articles and components are substantially perpendicularly aligned with respect to the direction of travel. Alternatively, a linear process may be used, in which the components are substantially longitudinally aligned along the direction of travel. In some arrangements, a combination of the two processes is used, for example, the combining may be carried out as a rolling process and the overwrapping may be carried out as a linear process. However, known apparatus and manufacturing processes are not suitable for manufacturing smoking articles in a multi-stage process where at least one component of the smoking article needs to be prevented from contacting at least one other component of the smoking article. Known apparatus and manufacturing processes for manufacturing smoking articles having a combustible heat source use a linear process in which multiple components are provided individually, and thus are slow in comparison to processes for manufacturing conventional cigarettes.

EP 2 210 509 A1 discloses one such method and apparatus for combining components of a smoking article, such as the heat source, aerosol generating substrate, expansion chamber, for the production of untipped smoking articles. The method comprises feeding a stream of components along a moving delivery path; compacting the stream of components into groups of two or more different components, each group corresponding to a discrete smoking article, wherein the components within a group abut one another and wherein there is a predefined space between a leading group of components and a trailing group of components; wrapping the components in a web of material; and cutting the web of material in each space between groups of components. EP 2 210 509 A1 teaches combining all of the components, except for the mouthpiece, within each of the smoking articles into linear groups of components, which are then wrapped, to form the untipped smoking articles. The untipped smoking articles are then attached to single mouthpieces by wrapping the untipped smoking article and the mouthpiece with tipping paper in a tipping machine to produce a finished smoking article.

It is an object of the present invention to provide an apparatus and a method suitable for manufacturing smoking articles having a combustible heat source and a plurality of other components that reduces the risk of the heat source from coming into contact with the mouthpiece of the smoking article. It would also be desirable to provide a method and apparatus suitable for manufacturing such smoking articles having a combustible heat source and a plurality of other components at relatively high speed compared to known apparatus and manufacturing processes.

According to a first aspect of the present invention, there is provided a method of manufacturing smoking articles. The method comprises forming first multi-segment components, each comprising a combustible heat source, an aerosol-forming substrate and an airflow directing segment. The first multi-segment component is formed by: feeding a stream of combustible heat sources, aerosol-forming substrates and airflow directing segments along a moving delivery path; compacting into groups the combustible heat sources, the aerosol-forming substrates and the airflow directing segments, each group corresponding to a discrete first multi-segment component; wrapping the combustible heat sources, aerosol-forming substrates, and airflow directing segments in a web of material; and cutting the web of material between groups to separate the individual first multi-segment components from each other.

As used herein, the term 'aerosol-forming substrate' is used to describe a substrate capable of releasing upon heating volatile compounds, which can form an aerosol.

As used herein, the term 'airflow directing segment' refers to the adjacent downstream segment from the aerosol-forming substrate, which defines a portion of the airflow pathway that is followed by the air inhaled by the user during use of the smoking article.

As used herein, the terms 'upstream' and 'front', and 'downstream' and 'rear', are used to describe the relative positions of components, or portions of components, of combustible heat sources and smoking articles according to the invention in relation to the direction of air drawn through the combustible heat sources and smoking articles during use thereof.

The method further comprises feeding a stream of the first multi-segment components onto a receiving means, and feeding a stream of second multi-segment components, each comprising a mouthpiece and at least one further segment, onto the receiving means. The first multi-segment component and a second multi-segment component are combined by wrapping the first multi-segment component and the second multi-segment component in a web material to form an individual smoking article having a combustible heat source at a first end and a mouthpiece at a second end.

Advantageously, providing such a method of manufacture increases the speed of manufacturing smoking articles having a combustible heat source. In addition, by manufacturing the first multi-segment component comprising the heat source separately from the second multi-segment component comprising the mouthpiece, the risk of the heat source contacting the mouthpiece of the smoking article is reduced.

The method of the present invention may be utilised to manufacture smoking articles in a three stage process. The first stage is to form a first multi-segment component, the second stage is to feed a first multi-segment component and a second multi-segment component into a combining apparatus, and the third stage is to combine the two multi-segment components together to form the smoking article.

The step of feeding the stream of segments along the moving delivery path preferably comprises interleaving each of the three types of segments comprising the first multi-segment component, such that the segments on the delivery path are in a desired and predetermined order. Preferably, the segments are interleaved along the moving delivery path such that the first multi-segment component comprises a combustible heat source at a first end, an airflow directing segment at a second end and an aerosol-forming substrate between the combustible heat source and the airflow directing segment.

Preferably, the segments on the delivery path have their longitudinal axes substantially aligned with each other and with the direction of movement of the delivery path. Such a linear forming process is advantageous since it causes minimal or no damage to the components within each first multi-segment component.

As used herein, the term 'longitudinal' is in reference to the direction of length of the smoking article.

Preferably, individual combustible heat sources are fed from a hopper. The combustible heat sources may be manufactured from a brittle material, such as a compressed particulate material, that may have a tendency to splinter, crumble, or fragment when cut with a conventional blade. Therefore, since the combustible heat sources are not cleanly cuttable, advantageously, the present method provides the combustible heat sources individually. The combustible heat sources are preferably substantially cylindrical and comprise a heat conductive back-coating on one end face. The method preferably comprises aligning the combustible heat sources, within the hopper, such that the combustible heat sources are fed onto the moving delivery path with the back-coating of each combustible heat source in substantially the same orientation.

Each heat source may be a carbonaceous or carbon-based heat source. Preferably, the heat source is cylindrical. In that case, each heat source on the delivery path preferably has its longitudinal axis substantially aligned with the direction of movement of the delivery path. The heat source may optionally include one or more airflow channels therethrough.

As used herein, the term 'carbon-based heat source' is used to describe a heat source comprised primarily of carbon. Combustible carbon-based heat sources for use in smoking articles according to the invention may have a carbon content of at least about 50 percent, preferably of at least about 60 percent, more preferably of at least about 70 percent, most preferably of at least about 80 percent by dry weight of the combustible carbon-based heat source.

As used herein, the term 'carbonaceous' is used to describe a combustible heat source comprising carbon. Preferably, combustible carbonaceous heat sources for use in smoking articles according to the invention have a carbon content of at least about 35 percent, more preferably of at least about 40 percent, most preferably of at least about 45 percent by dry weight of the combustible heat source.

As used herein, the term 'airflow channel' is used to describe a channel extending along the length of a combustible heat source through which air may be drawn downstream for inhalation by a user.

As used herein, the term 'airflow pathway' is used to describe a route along which air may be drawn through the smoking article for inhalation by a user.

Each aerosol-forming substrate may comprise tobacco material. Preferably, each aerosol-forming substrate is cylindrical. In that case, each substrate on the delivery path preferably has its longitudinal axis substantially aligned with the direction of movement of the delivery path.

Each airflow directing segment is downstream of the aerosol-forming substrate when the first multi-segment component is within the smoking article.

Preferably, the step of feeding a stream of combustible heat sources, aerosol-forming substrates and airflow directing segments comprises retaining the segments on the delivery path. In a preferred embodiment, the step of retaining the segments on the delivery path includes using a vacuum.

Preferably, the step of forming the first multi-segment component further comprises cutting at least one segment of the first multi-segment component on-line. In a preferred embodiment, the aerosol-forming substrate is cut on-line. Additionally, or alternatively, the airflow directing segment is cut on-line.

As used herein, the term 'on-line' connotes that the operation is conducted as a discrete step in the process of manufacturing a multi-segment component. As such, the segments of the smoking article that may be cut on-line may be provided as a substantially continuous stream of material that are cut as the segments are fed on to the moving delivery path.

In one alternative embodiment, the first multi-segment component further comprises an expansion chamber downstream of the airflow directing segment. In this alternative embodiment, the first multi-segment component comprises four segments, preferably arranged such that the combustible heat source is provided at a first end, and the expansion chamber is provided at the second end. In this embodiment, the aerosol-forming substrate is provided adjacent the combustible heat source and the airflow directing segment is provided adjacent the expansion chamber.

The expansion chamber preferably forms a portion of the airflow pathway of the smoking article. The inclusion of an expansion chamber advantageously allows further cooling of the aerosol generated by heat transfer from the combustible heat source to the aerosol-forming substrate. The expansion chamber also advantageously allows the overall length of smoking articles according to the invention to be adjusted to a desired value, for example to a length similar to that of conventional cigarettes, through an appropriate choice of the length of the expansion chamber. In one embodiment, the expansion chamber may be a hollow tube having a cross-sectional shape equivalent to the cross-sectional shape.

In the alternative embodiment, the second multi-segment component preferably comprises a mouthpiece and a filter segment.

Preferably, in compacting into groups the combustible heat sources, the aerosol-forming substrates and the airflow directing segments, there is a predefined space between a leading group of segments and a trailing group of segments.

In one embodiment, the step of compacting the stream of segments into groups of segments comprises: separating the stream of segments into groups, each group comprising a combustible heat source, an aerosol-forming substrate and an airflow directing segment, wherein each group corresponds to a discrete first multi-segment component; compacting the segments within a group such that they abut one another; and setting the pre-defined space between a leading group of segments and a trailing group of segments.

Preferably, the step of compacting the segments within a group such that they abut one another comprises compacting the segments such that the aerosol-forming substrate is compressed by the combustible heat source and the airflow directing segment.

The size of the pre-defined space is the size desired between groups of segments corresponding to discrete first multi-segment components. The web of material is cut at each space. Therefore, the size of each space is preferably accurate, since an inaccurate space could result in damage to the cutting means. The space should be sufficiently large so that the cutting means is able to cut the web of material, but sufficiently small so as not to waste the web of material. In one embodiment, the pre-defined spaced is about 1 mm±0.5 mm, that is, between about 0.5 mm and 1.5 mm. Even more preferably, the pre-defined space is between about 0.8 mm and 1.2 mm.

Preferably, the compacting means comprises: a first wheel having circumferentially spaced fixed fingers for separating the stream of segments into groups containing a combustible heat source, an aerosol-forming substrate and an airflow directing segment, wherein each group corresponds to a discrete first multi-segment component; a second wheel, downstream of the first wheel, having circumferentially spaced moveable fingers more closely spaced than the fixed fingers on the first wheel, for compacting the segments within a group such that they abut one another; and a third wheel, downstream of the second wheel, having circumferentially spaced moveable fingers, for setting the pre-defined space between a leading group of segments and a trailing group of segments.

Preferably, the step of wrapping the group of first multi-segment components in a web of material comprises wrapping the components in a paper web. Preferably, the web of material comprises pre-applied heat-conducting elements, for example patches of aluminium foil, spaced along the inside of the web of material. Preferably, the pre-applied heat-conducting elements are positioned such that the heat conducting element overlays at least a portion of the combustible heat source and at least a portion of the aerosol-forming substrate.

Preferably, the segments are substantially cylindrical, with a circular or elliptical cross section.

In a particularly preferred embodiment, the combining step further comprises: receiving sets of discrete first multi-segment components, each set of discrete first multi-segment components comprising two first multi-segment components; separating, along the longitudinal axis of the first multi-segment components, the first multi-segment components in each set of discrete first multi-segment components; receiving, between the separated first multi-segment components, a set of discrete second multi-segment components, each set of discrete second multi-segment components comprising two second multi-segment components joined such that the mouthpieces of each second multi-segment component are adjacent each other; aligning the longitudinal axes of the first and second multi-segment components on a combining drum; compacting the first and second multi-segment components into a group; wrapping the group in the web material to form a double smoking article; and cutting the double smoking article between the mouthpieces of the two second multi-segment components to form individual smoking articles.

Advantageously, providing discrete second multi-segment components comprising two second multi-segment components joined together, thus manufacturing double smoking articles, allows the manufacturing process to operate at higher speed as compared to manufacturing single smoking articles.

In that particularly preferred embodiment, preferably the method further comprises, after the first multi-segment components are cut, rotating every alternate first multi-segment component, such that each set of first multi-segment components are received with the combustible heat sources of each first multi-segment component facing opposite directions.

Preferably, during the step of combining the first multi-segment component and the second multi-segment component, the first multi-segment component is further wrapped with an outer heat-conducting element. The outer heat-conducting element may be formed of any suitable heat-resistant material or combination of materials with an appropriate thermal conductivity. Preferably, the outer heat-conducting element has a thermal conductivity of between about 10 Watts per meter Kelvin (W/(m·K)) and about 500 Watts per meter Kelvin (W/(m·K)), more preferably between about 15 Watts per meter Kelvin (W/(m·K)) and about 400 Watts per meter Kelvin (W/(m·K)), at 23° C. and a relative humidity of 50% as measured using the modified transient plane source (MTPS) method. Suitable outer heat-conducting elements for use in smoking articles according to the invention include, but are not limited to: metal foil wrappers such as, for example, aluminium foil wrappers, steel wrappers, iron foil wrappers and copper foil wrappers; and metal alloy foil wrappers.

In a particularly preferred embodiment, the first multi-segment component is further wrapped with an outer heat-conducting element comprises one or more layers of a heat-reflective material, such as aluminium or steel. As used herein the term 'heat-reflective material' refers to a material that has a relatively high heat reflectivity and a relatively low heat emissivity such that the material reflects a greater proportion of incident radiation from its surface than it emits. Preferably, the material reflects more than 50% of incident radiation, more preferably more than 70% of incident radiation and most preferably more than 75%.

Alternatively, the first multi-segment component is further wrapped with an outer heat-conducting element comprising one or more layers of a heat-reflective material before or after the first multi-segment component and the second multi-segment component are wrapped in the web material to form the smoking article.

Preferably, the web material used to help form the smoking article is tipping paper. Preferably, the tipping paper comprises a pre-applied adhesive to one side, such that the tipping paper adheres to the first multi-segment component and the second multi-segment component.

The method may further comprise receiving a multiple second multi-segment component, wherein the multiple second multi-segment component comprises four, eight or more second multi-segment components. In this embodiment, the method preferably further comprises cutting the multiple second multi-segment component to provide sets of discrete second multi-segment components, each set comprising two second multi-segment components joined such that the mouthpieces of each second multi-segment component are adjacent each other.

Preferably, the mouthpiece of the second multi-segment component is manufactured from cellulose acetate tow.

Preferably, the further segment of the second multi-segment component may comprise an expansion chamber or a filter segment. In a particularly preferred embodiment, each second multi-segment component comprises a mouthpiece at a first end of the second multi-segment component, an expansion chamber at a second end of the second multi-segment component and a filter segment adjacent the mouthpiece and the expansion chamber. Preferably, the longitudinal axes of the mouthpiece, the filter segment and the expansion chamber are substantially aligned. In one embodiment, the filter segment may be an aerosol cooling segment, manufactured from, for example, polylactic acid (PLA).

Preferably, the method further comprises providing perforations circumferentially around the first multi-segment component. Preferably, the perforations are provided during the step of wrapping the first multi-segment component and the second multi-segment component in the web material. Alternatively, the perforations are provided either before or after the first multi-segment component and the second multi-segment component are wrapped in the web material to form the smoking article. Preferably, the perforations are provided utilising a laser.

According to a further aspect of the present invention, there is provided an apparatus for manufacturing smoking articles. The apparatus comprises means for forming first multi-segment components each comprising at least a combustible heat source, an aerosol-forming substrate, and an airflow directing segment. The forming means comprises: feeding means for feeding a stream of combustible heat sources, aerosol-forming substrates and airflow directing segments along a moving delivery path; compacting means for compacting into groups the combustible heat sources, the aerosol-forming substrate and the airflow directing segments, each group corresponding to a discrete first multi-segment component; wrapping means for wrapping the combustible heat sources, the aerosol-forming substrates, and the airflow directing segments in a web of material; and cutting means for cutting the web of material between groups to separate the individual first multi-segment components from each other. The apparatus further comprises: a first feeding assembly for feeding a stream of first multi-segment components; a second feeding assembly for feeding a stream of second multi-segment components each comprising a mouthpiece and at least one further segment; and combining means for combining a first multi-segment component and a second multi-segment component by wrapping the first multi-segment component and the second multi-segment component in a web material to form an individual smoking article having a combustible heat source at a first end and a mouthpiece at a second end.

Advantageously, providing such apparatus increases the speed of manufacturing smoking articles having a combustible heat source. In addition, by manufacturing the first multi-segment component comprising the heat source separately from the second multi-segment component comprising the mouthpiece, the risk of the heat source contacting the mouthpiece of the smoking article is reduced.

Preferably, the feeding means comprises means for interleaving each of the three segments with others of the three segments, such that the segments on the delivery path are in a desired and predetermined order. Preferably, the segments are interleaved along the moving delivery path such that the first multi-segment component comprises a combustible heat source at a first end, an airflow directing segment at a second end and an aerosol-forming substrate between the combustible heat source and the airflow directing segment. The feeding means preferably comprises a combustible heat source feed wheel configured to receive individual combustible heat sources and feed the individual combustible heat sources on to the moving delivery path.

The feeding means preferably comprises an aerosol-forming substrate feed wheel configured to feed individual aerosol-forming substrate segments on to the moving delivery path. In a preferred embodiment, the aerosol-forming substrate feed wheel comprises means for receiving a continuous stream of aerosol-forming substrate material and means for cutting individual aerosol-forming substrate segments.

The feeding means preferably comprises an airflow directing segment feed wheel configured to feed individual airflow directing segments on to the moving delivery path. The airflow directing segment feed wheel preferably comprises means for receiving a continuous stream of airflow directing segment material and means for cutting individual airflow directing segments.

In one embodiment, the airflow directing segment comprises an elongate hollow tube having substantially the same outer diameter as the aerosol-forming substrate. Preferably, the airflow directing segment, further comprises an open ended, substantially air impermeable, hollow tube of reduced diameter compared to the aerosol-forming substrate and an annular substantially air impermeable seal of substantially the same outer diameter as the aerosol-forming substrate, which circumscribes the hollow tube downstream of the at least one air inlet.

In the preferred airflow directing segment, the volume bounded radially by the exterior of the hollow tube and an outer wrapper of the smoking article defines the first portion of the airflow pathway that extends longitudinally upstream from the at least one air inlet towards the aerosol-forming substrate and the volume bounded radially by the interior of the hollow tube defines the second portion of the airflow pathway that extends longitudinally downstream towards the mouth end of the smoking article. The preferred airflow directing element may further comprise an inner wrapper, which circumscribes the hollow tube and the annular substantially air impermeable seal.

In this preferred embodiment of the airflow directing segment, the volume bounded radially by the exterior of the hollow tube and the inner wrapper of the airflow directing element defines the first portion of the airflow pathway that extends longitudinally upstream from the at least one air inlet towards the aerosol-forming substrate and the volume bounded by the interior of the hollow tube defines the second portion of the airflow pathway that extends longitudinally downstream towards the mouth end of the smoking article. The open upstream end of the hollow tube may abut a downstream end of the aerosol-forming substrate. The preferred airflow directing element may further comprise an annular air permeable diffuser of substantially the same outer diameter as the aerosol-forming substrate, which circumscribes at least a portion of the length of the hollow tube upstream of the annular substantially air impermeable seal. For example, the hollow tube may be at least partially embedded in a plug of cellulose acetate tow.

In an alternative embodiment of the airflow directing segment, an airflow directing element is located downstream of the aerosol-forming substrate and comprises an open-ended, substantially air impermeable truncated hollow cone made of, for example, cardboard. The downstream end of the open-ended truncated hollow cone is of substantially the same diameter as the aerosol-forming substrate and the upstream end of the open-ended truncated hollow cone is of reduced diameter compared to the aerosol-forming substrate.

In the alternative embodiment, the upstream end of the hollow cone abuts the aerosol-forming substrate and is circumscribed by an air permeable cylindrical plug of substantially the same diameter as the aerosol-forming substrate. The air permeable cylindrical plug may be formed from any suitable material including, but not limited to porous materials such as, for example, cellulose acetate tow of very low filtration efficiency. The upstream end of the open-ended truncated hollow cone abuts the aerosol-forming substrate and is circumscribed by an annular air permeable diffuser made of, for example, cellulose acetate tow, which is of substantially the same diameter as the aerosol-forming substrate 6 and is circumscribed by filter plug wrap.

The portion of the open-ended truncated hollow cone that is not circumscribed by the annular air permeable diffuser is circumscribed by an inner wrapper of low air permeability made of, for example, cardboard.

A circumferential arrangement of air inlets is provided in the outer wrapper and the inner wrapper circumscribing the open-ended truncated hollow cone downstream of the annular air permeable diffuser.

As used herein, the term 'air inlet' is used to describe one or more holes, slits, slots or other apertures in the outer wrapper and any other materials circumscribing the smoking article through which air may be drawn into the one or more airflow pathways. Preferably, the segments on the delivery path have their longitudinal axes substantially aligned with each other and with the direction of movement of the delivery path. Such a linear forming process is advantageous since it causes minimal or no damage to the components within each first multi-segment component.

The apparatus may further comprise a further feed wheel, configured to receive an expansion chamber. In this embodiment, the expansion chamber is provided adjacent the airflow directing segment such that it is at the second end of the first multi-segment component.

Preferably the delivery path is a continuous belt. In a preferred embodiment, the belt comprises vacuum means for providing a vacuum to the belt such that the individual segments of the first multi-segment component are retained on the belt. Preferably, the continuous vacuum belt comprises a plurality of holes through which the vacuum is applied to the segments of the first multi-segment component.

Preferably, the means for forming the first multi-segment component further comprises a hopper for feeding individual combustible heat sources along the delivery path. Where the feeding means comprises a combustible heat source feed wheel, the hopper is configured to provide individual combustible heat sources to the combustible heat source feed wheel. Preferably, the cross-sectional shape of the combustible heat sources is circular, or elliptical.

Preferably, the means for forming the first multi-segment component further comprises segment cutting means for cutting at least one of the segments. Where the feeding means comprises an aerosol-forming substrate feed wheel, the further segment cutting means is preferably configured to receive a continuous stream, or supply, of aerosol-forming substrate material, to cut the aerosol-forming substrate material into individual aerosol-forming substrate segments, and to provide the individual aerosol-forming substrate segments to the aerosol-forming substrate feed wheel. Where the feeding means comprises an airflow directing segment feed wheel, the further segment cutting means is preferably configured to receive a continuous stream, or supply, of airflow directing segment material, to cut the airflow directing segment material into individual airflow directing segments, and to provide the individual airflow directing segments to the airflow directing segment feed wheel.

Preferably, the means for cutting the first multi-segment components comprises a flying knife type arrangement. Thus, advantageously, the first multi-segment component forming means may operate continuously.

Preferably, the means for forming the first multi-segment component comprises three wheels configured to compact the segments together.

Preferably the apparatus further comprises a turning drum, after the cutting means, for rotating every alternate first multi-segment component, such that each set of first multi-segment components are received with the combustible heat sources of each first multi-segment component facing opposite directions.

The apparatus may further comprise a receiving drum configured to receive the first multi-segment components from the first multi-segment component forming means, and to feed the first multi-segment components to the turning drum.

Preferably, the combining means further comprises: a first receiving means for receiving sets of discrete first multi-segment components, each set of first multi-segment components comprising two first multi-segment components; separating means for separating, along the longitudinal axis of the first multi-segment components, the first multi-segment components in each set of first multi-segment components; a second receiving means for receiving, between the separated first multi-segment components in each set of first multi-segment components, a set of discrete second multi-segment components, each set of discrete second multi-segment components comprising two second multi-segment components joined such that the mouthpieces of each second multi-segment component are adjacent each other; aligning means for aligning the longitudinal axes of the first multi-segment components and second multi-segment components on the second receiving means; compacting means for compacting the first multi-segment components and second multi-segment components into a group; wrapping means for wrapping the group of first multi-segment components and second multi-segment components in the web material to form a double smoking article; and cutting means for cutting the double smoking article between the mouthpieces of the set of second multi-segment components to form individual smoking articles.

Advantageously, providing a set of discrete second multi-segment components comprising two second multi-segment components joined together, thus manufacturing double smoking articles, allows the manufacturing apparatus to operate at higher speed as compared to manufacturing single smoking articles.

In one embodiment the further segment of the second multi-segment component comprises an aerosol cooling segment. Preferably the aerosol cooling segment is manufactured from PLA.

Preferably, the web material utilised to wrap the first multi-segment component and the second multi-segment components is tipping paper. Preferably, the tipping paper is provided with a pre-applied adhesive to adhere the tipping paper to the first multi-segment component and the second multi-segment component.

In order to further increase the manufacturing speed of the apparatus, two first multi-segment component forming means are provided upstream of the combining means. In this way, the speed of manufacture may be yet further increased because the forming of the first multi-segment component is often the slowest process when manufacturing the smoking articles. In this embodiment, the two first multi-segment component forming means may be configured such that the first multi-segment components are provided to the combining means oriented such that the combustible heat sources are facing opposite directions. Orienting the first multi-segment components in this way allows the turning drum to be removed from the apparatus, and thus the apparatus may operate more efficiently.

Preferably, the combining means further comprises second wrapping means for wrapping, with an outer heat-conducting element comprising one or more layers of a heat-reflective material, the first multi-segment component such that the outer heat-conducting element overlays the combustible heat source and the aerosol-forming substrate.

Preferably, the combining means further comprises means for perforating each first multi-segment component around the circumference of the smoking article. Preferably, the perforating means comprises at least one laser. Preferably, the laser is configured to perforate each first multi-segment component as the first multi-segment component and the second multi-segment component are being wrapped by the web material. Where one laser is utilised to provide perforations in two first multi-segment component simultaneously, a series of optical elements are utilised to direct the laser.

In alternative embodiments, a so-called 'spider' machine may be utilised instead of the above described turning drum. The 'spider' machine utilises, mechanically or electronically controlled, feed arms comprising means for holding the smoking article components, and means for orienting the smoking article components. Thus, the 'spider' machine enables smoking article components to be fed from a first stream of components having a first orientation onto a second stream of components having a second orientation. The 'spider' machine may feed first multi-segment components from the means for forming first multi-segment components onto the combining drum for combining the first multi-segment components with the second multi-segment components.

As used herein, means plus function features may be expressed alternatively in terms of their corresponding structure.

Any feature relating to one aspect may be applied to other aspects, in any appropriate combination. In particular, method aspects may be applied to apparatus aspects, and vice versa. Furthermore, any, some or all features in one aspect can be applied to any, some or all features in any other aspect, in any appropriate combination.

It should also be appreciated that particular combinations of the various features described and defined in any aspects of the invention can be implemented or supplied or used independently.

The invention will be further described, by way of example only, with reference to the accompanying drawings in which.

Figure 1:
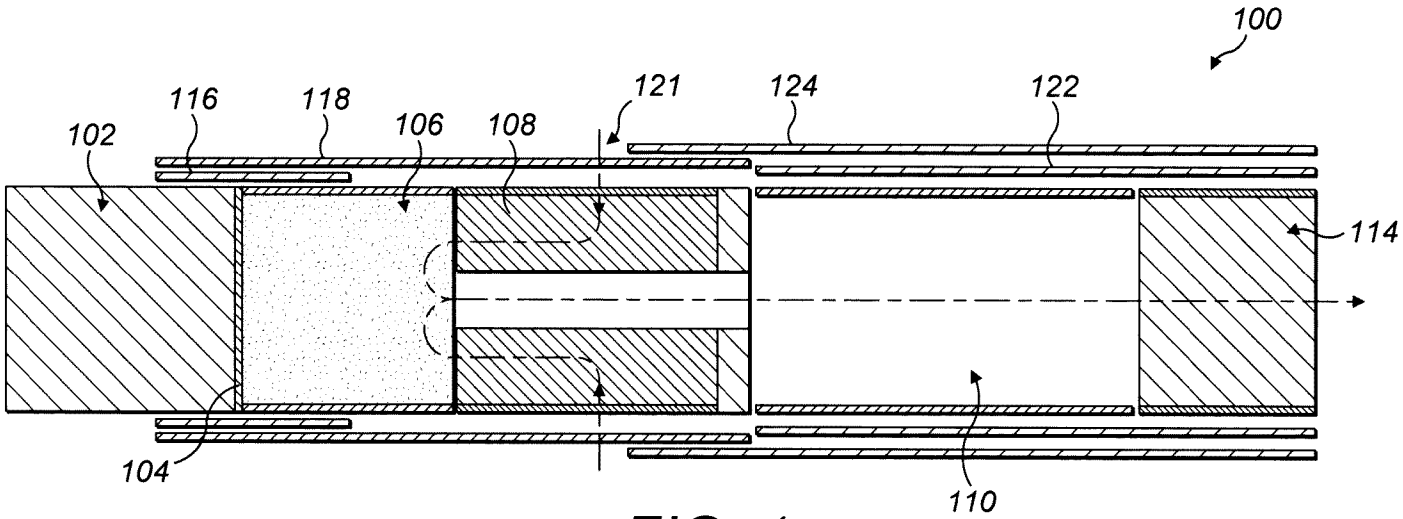
FIG. 1 shows a schematic representation of a smoking article comprising a combustible heat source manufactured by the method and apparatus according to the present invention.

FIG. 1 shows a cross-sectional schematic representation of a smoking article 100. The process is described in detail below with reference to the following features of the smoking article. The smoking article 100 comprises a combustible heat source 102, the combustible heat source having a barrier 104. The barrier is a layer of aluminium foil affixed to one end of the combustible heat source utilising an adhesive. Longitudinally adjacent the combustible heat source, an aerosol-forming substrate 106 is provided. The aerosol-forming substrate 106 comprises a tobacco material. The smoking article further comprises an airflow directing segment 108, an expansion chamber 110, an aerosol cooling segment, and a mouthpiece filter 114.

The combustible heat source 102, the aerosol-forming substrate 106 and the airflow directing segment 108 are wrapped in wrapper 116 to form a first multi-segment component of the smoking article 100. The first multi-segment component is wrapped in an inner heat-conductive layer 118, such as an aluminium foil, that overlays both the combustible heat source 102 and the aerosol-forming substrate 106. In addition, the first multi-segment component is wrapped in an outer heat-conductive material comprising a layer of a heat-reflective material, such as aluminium foil. The outer heat-conductive material overlays the wrapper 116, and is positioned adjacent the combustible heat source and the aerosol-forming substrate. The wrapper 116 is provided with perforations 121 disposed circumferentially around the smoking article adjacent the airflow directing segment 108.

The expansion chamber 110, the aerosol cooling segment and the mouthpiece 114 are wrapped in wrapper 122 to form a second multi-segment component of the smoking article 100. The first multi-segment component and the second multi-segment component are further wrapped in wrapper 124 to join the two components together to form the smoking article. The wrapper 124 is a tipping paper.

Figure 2A:
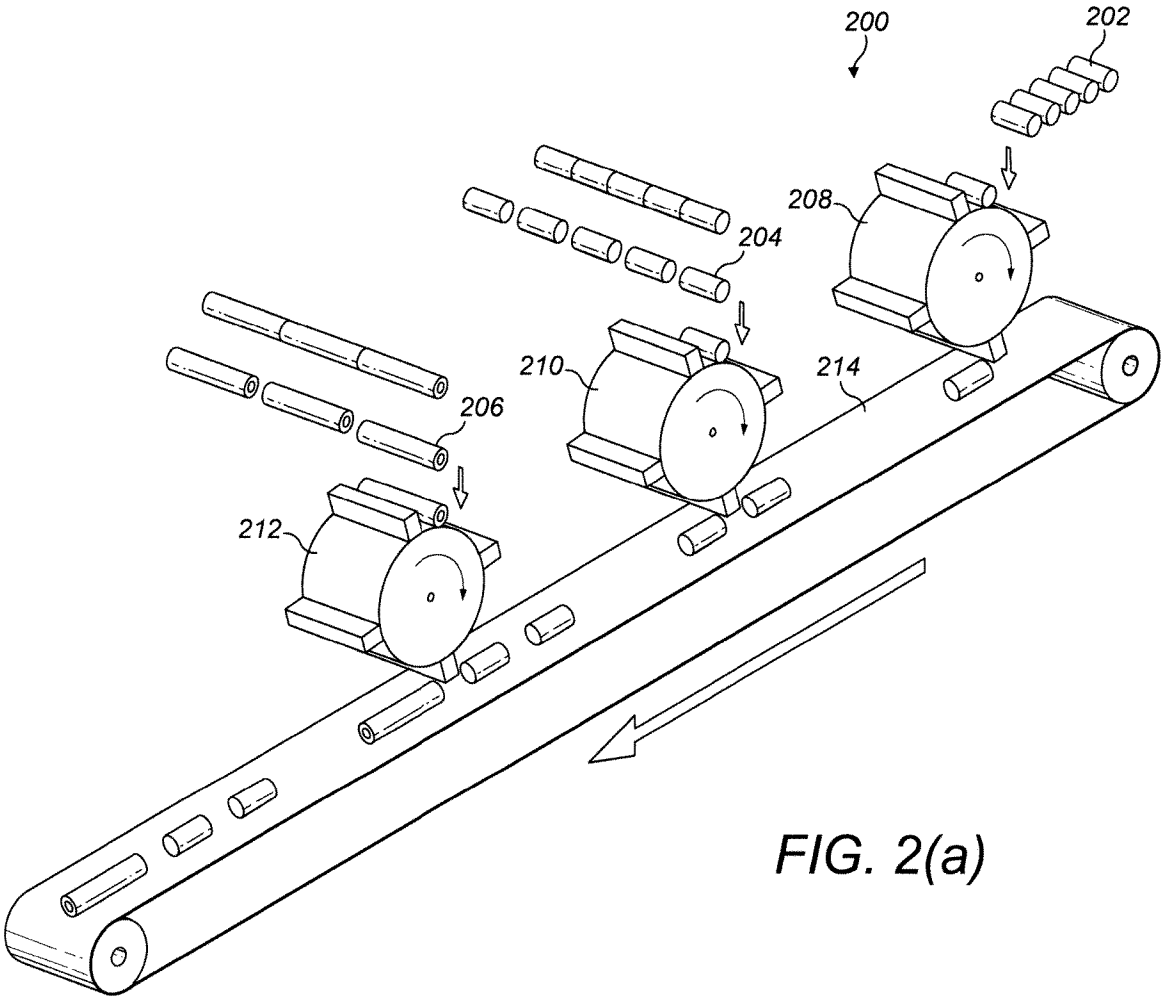
FIG. 2 show a schematic representation of an apparatus for forming a first multi-segment component.
Figure 2B:
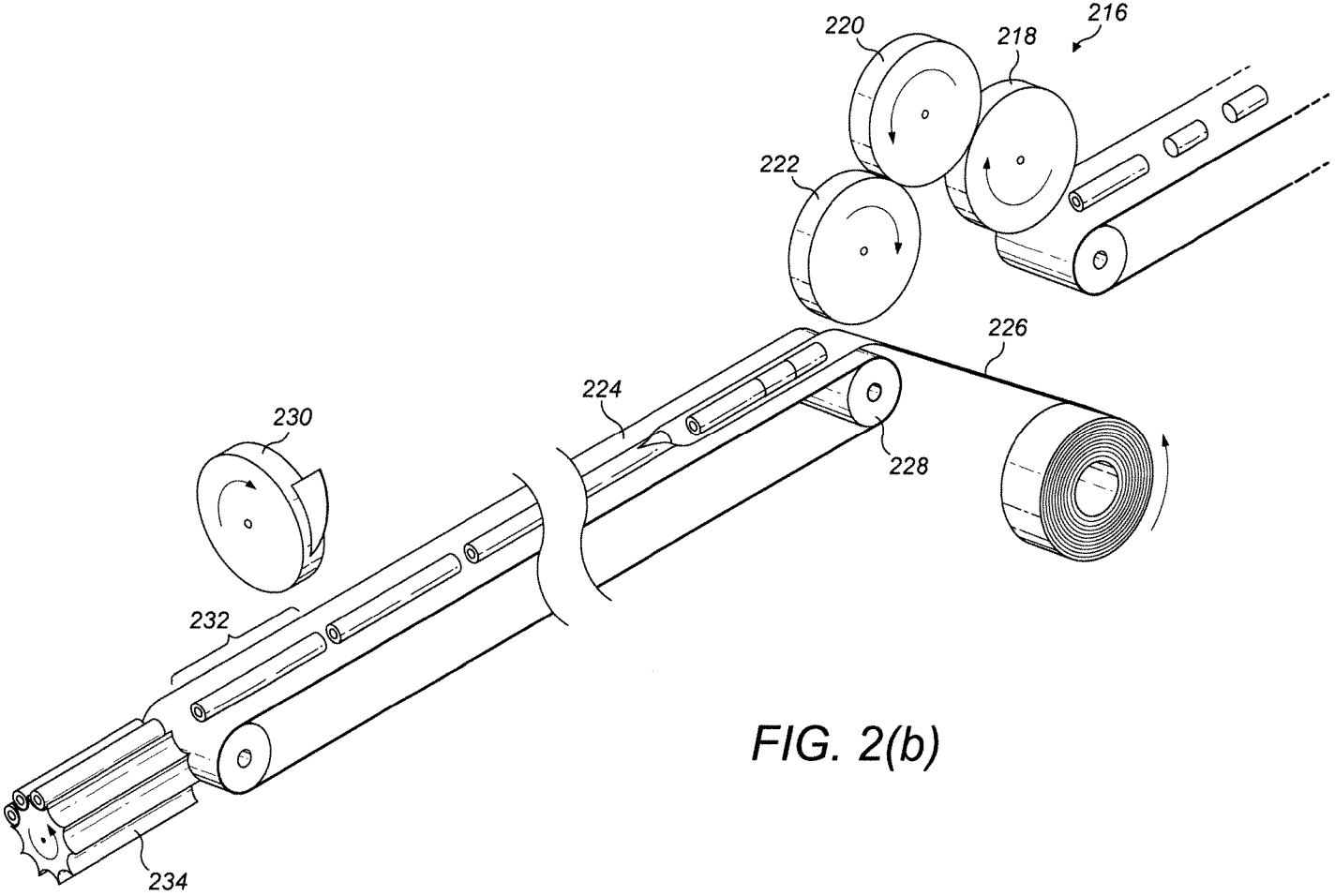

FIG. 2 show a perspective schematic view of one exemplary embodiment of the apparatus for forming first multi-segment components of the present invention. FIG. 2 show an embodiment of apparatus for combining a plurality of segments for the production of the first multi-segment component. The apparatus 200 shown in FIG. 2 is arranged to combine the combustible heat sources 202, aerosol-generating substrates 204 and airflow directing segments 206 to form first multi-segment components, which may be combined with second multi-segment components, optionally using tipping paper, to form finished smoking articles.

Referring to FIG. 2(*a*), the apparatus 200 comprises first feeding means 208 for feeding the pre-cut discrete combustible heat sources 202, second feeding means 210 for the aerosol-generating substrates 204, and third feeding means 212 for the airflow directing segments 206. The first feeding means 208 may comprise a vibrating bowl, a belt and an indexing wheel (not shown). The second feeding means 210 may comprise a hopper, primary and secondary supply drums, a vacuum belt and an indexing wheel (not shown). The third feeding means 212 may comprise a hopper primary and secondary supply drums, a vacuum belt and an indexing wheel (not shown). The apparatus 200 further comprises vacuum belt 214 for receiving the components, holding them using the vacuum, and moving them along a delivery path.

Referring now to FIG. 2(*b*), the apparatus 200 further comprises compacting means 216 for compacting the stream of components into groups of components, in the form of wheels 218, 220, and 222, a garniture region 224 using paper web feed 226 and belt 228, and cutting means in the form of blade 230. The wheels 218, 220 and 220 each comprise a plurality of indexed fingers for holding the segments. The indexed fingers sequentially compact the segments together as they are moved from the first wheel 218 to the third wheel 222.

The general operation of the FIG. 2 apparatus 200 is as follows. The combustible heat sources 202 are introduced from vibrating bowl onto the belt, then via the indexing wheel onto vacuum belt 214. The aerosol-generating substrates 204 are introduced from hopper, via the primary and secondary supply drums onto the vacuum belt of the second feeding means, then via the indexing wheel onto vacuum belt 214. Similarly, the airflow directing segments are introduced from hopper, via primary and secondary supply drums onto the vacuum belt of the third feeding means, then via the indexing wheel onto vacuum belt 214. The various segments 202, 204 and 206 are introduced with appropriate spacing and speed such that their longitudinal axes are substantially axially aligned with each other and with the direction of movement of vacuum belt 214 in the required order.

The various segments pass along the vacuum belt 214 in order, and then pass into the compacting means 216. The function of the compacting means 216 is to compact the stream of segments into groups of segments, each group corresponding to a discrete first multi-segment component, so that the segments within a group abut one another and there is a predefined space between a leading group of segments and a trailing group of segments. In one embodiment the gap between groups of segments may be 1 mm±0.5 mm, that is, between 0.5 mm and 1.5 mm, or more preferably between 0.8 mm and 1.2 mm. Further, the compacting means 216 registers the position of each space so that the blade 230 can cut the web of material in each space between groups of components.

After the compacting means 216, the components are overwrapped with paper web in the garniture region 224. The paper web feed 226 may include pre-applied heat-conducting elements, such as aluminium foil patches, appropriately spaced along the web material. Once the components have been overwrapped with the paper web from feed 226, the web is cut at appropriate junctures, at blade 230 to form discrete first multi-segment components 232.

Referring again to FIG. 2(*a*), as can be seen, the second feeding means 210 for feeding the aerosol-forming substrates comprises means for cutting discrete aerosol-forming substrates from a continuous supply of aerosol-forming substrate material. Similarly, the third feeding means 212 for feeding the airflow directing segments comprises means for cutting discrete airflow directing segments from a continuous supply of airflow directing segment material.

Figure 3:
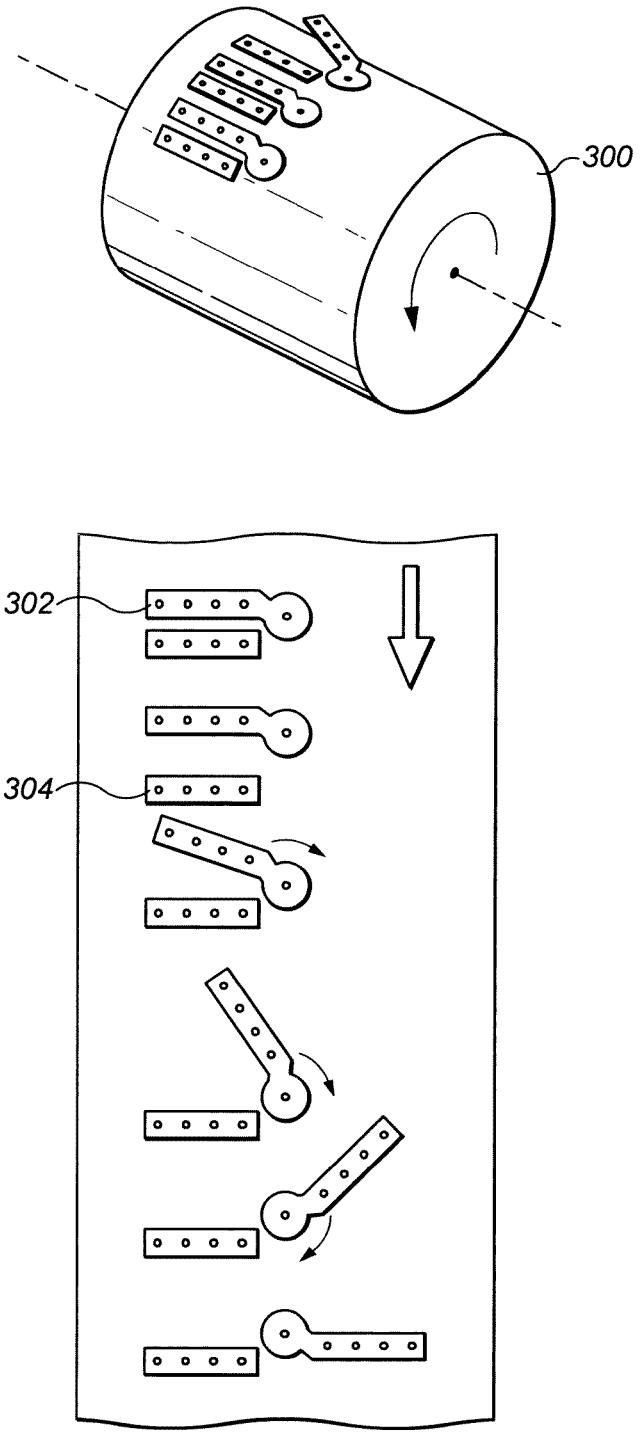
FIG. 3 shows a schematic representation of an apparatus for turning alternate first multi-segment components.

The discrete first multi-segment components 232 are then provided to a transfer drum 234 from the belt 228. The transfer drum 234 transfers the first multi-segment components from the first multi-segment forming apparatus to the combining apparatus discuss in further detail below. As shown in FIG. 3, a turning drum 300 is provided to receive the first multi-segment components from the transfer drum 234. Alternatively, the turning drum 300 may receive the first multi-segment components directly from the belt 228. The turning drum 300 comprises a plurality of receiving flutes 302, 304 for holding the first multi-segment components. Each alternate flute 304 is rotatable such that the first multi-segment component can be rotated such that it is longitudinally aligned with a corresponding non-rotated flute 302 (shown in the expanded view of turning drum 300). In this way, the first multi-segment components can be aligned such that the combustible heat sources are facing in opposite directions.

Figure 4:
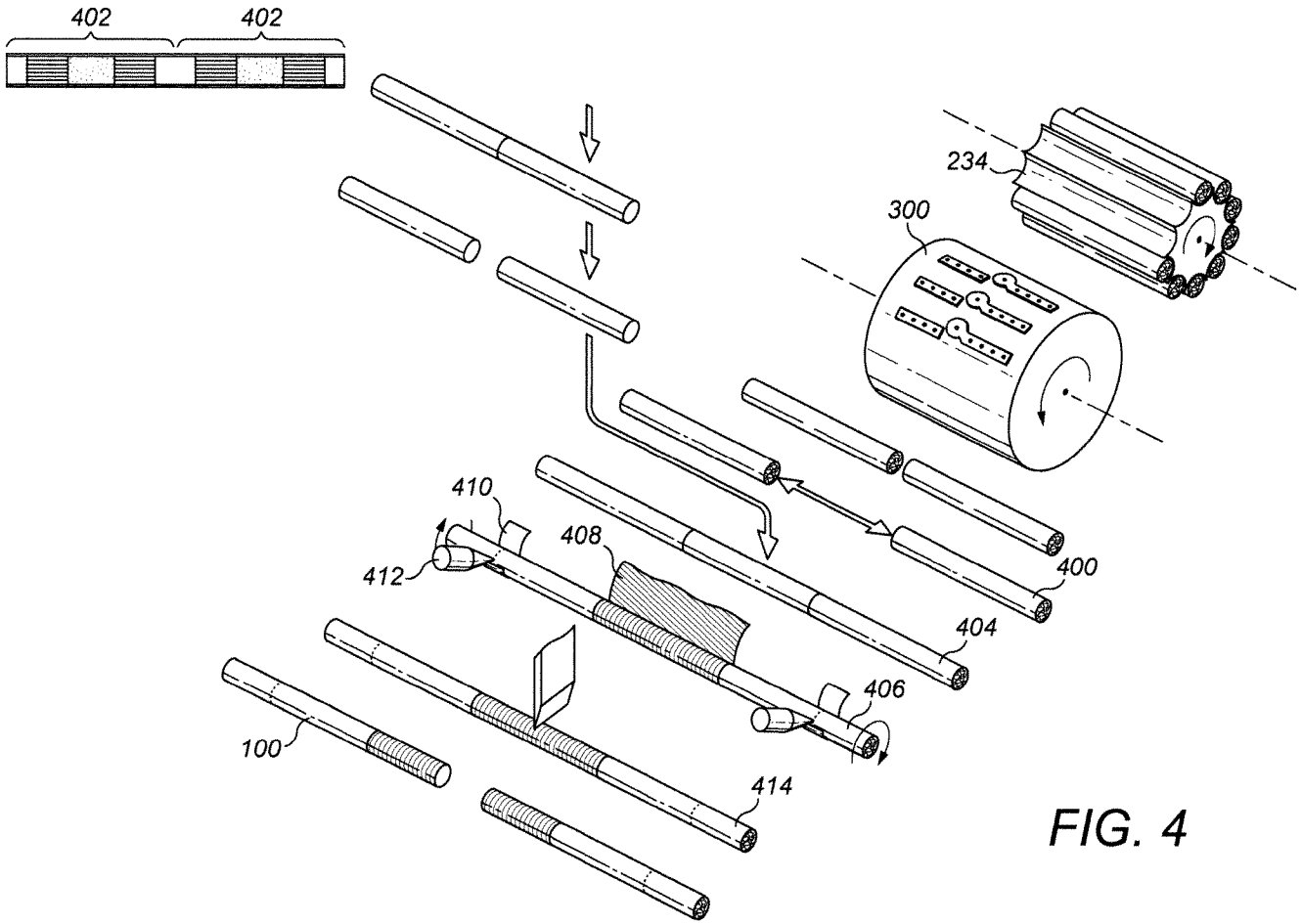
FIG. 4 shows a schematic representation of an apparatus for combining a first multi-segment component and a second multi-segment component to form a smoking article.

Referring now to FIG. 4, the apparatus for combining first multi-segment components with second multi-segment components to form smoking articles is schematically. As described above, the transfer drum 234 transfers the first multi-segment components from the belt 228 to the turning drum 300. The first multi-segments are arranged and oriented, by a first feeding assembly, such that pairs of first multi-segment have their longitudinal axes aligned and the combustible heat sources are facing opposite directions. The pairs of first multi-segment components are then transferred to a separating drum 400. The separating drum is configured to move the pair of first multi-segments along their longitudinal axis to provide a gap between the airflow directing segments of the respective first multi-segment components. The gap is provided to facilitate placing the second multi-segment components between the first multi-segment components.

In one preferred embodiment, the second multi-segment components 402 are supplied in multiple sets of second multi-segment components. As can be seen in FIG. 4, the second multi-segment components 402 may be supplied, for instance, comprising two sets of second multi-segment components, wherein each set comprises two second multi-segment components (e.g., a first second multi-segment component, and a second second multi-segment component). Before the second multi-segment components are provided to the combining apparatus, they are cut to form two sets of second multi-segment components. The set of second multi-segment components is arranged such that the mouthpiece end of the first second multi-segment component is adjacent the mouthpiece end of the second second multi-segment component. The set of second multi-segment components is positioned, by a second feeding assembly, between the two separated first multi-segment components on combining drum 404. The multi-segment components are then transferred to the wrapping drum 406. The wrapping drum is configured to compact the first multi-segment components and the second multi-segment components together such that there is no gap between the components. The wrapping drum may be provided with fingers, or the like, positioned adjacent the combustible heat sources of the first multi-segment components to effect the compaction. The fingers may be mechanically, or electrically, controlled, such as with a cam mechanism.

The compacted first and second multi-segment components are then wrapped in a web material, such as tipping paper 408. This process is effected by rotating the components about their longitudinal axis. The tipping paper is provided with a pre-applied adhesive to ensure that the components are held together securely. The tipping paper is sufficiently wide to combine each of the first multi-segment components in a pair to the set of second multi-segment components in a single wrapping operation. In one preferred embodiment, the tipping paper covers the second multi-segment component, and overlaps with the first multi-segment component by about 5 mm. The wrapping process results in a joined pair of smoking articles, each smoking article comprising a first multi-segment component and a second multi-segment component as described above.

During the wrapping process, an outer heat-conducting layer 410 may be provided on the first multi-segment components. The outer heat-conducting layer is made from a heat-reflective material, such as aluminium. Similarly to the tipping paper, the outer heat-conducting layer may be provided with a pre-applied adhesive to securely affix the heat-conducting layer to the first multi-segment component. The outer-heat-conducting layer 410 is provided in the region adjacent the combustible heat source and the aerosol-forming substrate.

Also during the wrapping process, perforations are cut into the first multi-segment components in the region adjacent the airflow directing segment. The perforations are made utilising a stationary pulsing laser 412 that cuts perforations around the circumference of the first multi-segment component as it rotates. Two such lasers may be provided to enable perforations to be cut into each first multi-segment component in a pair. Alternatively, an optical system of lenses and mirrors may be provided to utilise a single laser to cut two sets of perforations simultaneously.

The joined pair of smoking articles is then transferred to a cutting drum 414. As can be seen in FIG. 4, the cutting drum cuts the joined pair of smoking articles into individual finished smoking articles 100. In this process, the tipping paper is cut between the mouthpieces of the second multi-segment components.

Throughout the above process, it can be seen that the combustible heat sources do not come into contact with any other component. This is important since the combustible heat sources are made from particulate material that may have a tendency to splinter or crumble and leave a residue on any other component that it contacts.

The embodiments and examples described above illustrate but do not limit the invention. Other embodiments of the invention may be made without departing from the spirit and scope thereof, and it is to be understood that the specific embodiments described herein are not limiting.

The invention claimed is:

1. A method of manufacturing smoking articles, comprising:

forming first multi-segment components each comprising a combustible heat source, an aerosol-forming substrate and an airflow directing segment by:

feeding a stream of combustible heat sources, aerosol-forming substrates and airflow directing segments along a moving delivery path, wherein at least one segment of the first multi-segment component is cut on-line;

compacting into groups the combustible heat sources, the aerosol-forming substrates and the airflow directing segments, each group corresponding to a discrete first multi-segment component;

wrapping the combustible heat sources, aerosol-forming substrates, and airflow directing segments in a web of material; and cutting the web of material between groups to separate the individual first multi-segment components from each other;

feeding a stream of first multi-segment components onto a receiving means;

feeding a stream of second multi-segment components, each comprising a mouthpiece and at least one further segment, onto the receiving means; and combining a first multi-segment component and a second multi-segment component by wrapping the first multi-segment component and the second multi-segment component in a web material to form an individual smoking article having a combustible heat source at a first end and a mouthpiece at a second end.

2. The method according to claim 1, wherein the segments on the moving delivery path have their longitudinal axes substantially aligned with each other and with a direction of movement of the moving delivery path.

3. The method according to claim 1, wherein, in compacting into groups the combustible heat sources, the aerosol-forming substrates and the airflow directing segments, there is a predefined space between a leading group of segments and a trailing group of segments.

4. The method according to claim 1, wherein individual combustible heat sources are fed from a hopper.

5. The method according to claim 1, wherein the combining step further includes:

receiving sets of discrete first multi-segment components, each set of discrete first multi-segment components comprising two first multi-segment components;

separating, along a longitudinal axis of the first multi-segment components, the first multi-segment components in each set of discrete first multi-segment components;

receiving, between the separated first multi-segment components, a set of discrete second multi-segment components, each set of discrete second multi-segment components comprising two second multi-segment components joined such that the mouthpieces of each second multi-segment component are adjacent each other;

aligning the longitudinal axes of the first and second multi-segment components on a combining drum;

compacting the first and second multi-segment components into a group;

wrapping the group in the web material to form a double smoking article; and cutting the double smoking article between the mouthpieces of the two second multi-segment components to form individual smoking articles.

6. The method according to claim 1, wherein, during the step of combining the first multi-segment component and the second multi-segment component, the first multi-segment component is further wrapped with a heat conducting element comprising one or more layers of a heat-reflective material.

7. The method according to claim 1, wherein the first multi-segment component further comprises an expansion chamber.

8. The method according to claim 7, wherein the at least one further segment of the second multi-segment component further comprises a filter segment.

* * * * *